US005551866A

United States Patent [19]

Josephs et al.

[11] Patent Number: 5,551,866

[45] Date of Patent: Sep. 3, 1996

[54] SAFETY SYSTEM AND FUEL CAP FOR INHIBITING OPERATION OF AN APPARATUS DURING REFUELING

[76] Inventors: Harold Josephs, 25311 Ronald Ct., Oak Park, Mich. 48237; Ronald W. Szczesny, 27333 Spring Arbor Dr., Southfield, Mich. 48075

[21] Appl. No.: 298,225

[22] Filed: Aug. 29, 1994

[51] Int. Cl.[6] ..... F23D 11/36

[52] U.S. Cl. ..... 431/153; 123/198 D; 431/319; 431/298

[58] Field of Search ..... 431/153, 302, 431/298, 319, 320, 321; 123/198 D, 198 DC, 198 B, 630

[56] References Cited

U.S. PATENT DOCUMENTS

| | | | |
|---|---|---|---|
| 250,041 | 11/1881 | Fritz | 431/153 |
| 322,387 | 7/1885 | Lightburne, Jr. | 431/153 |
| 341,194 | 5/1886 | Wellington | 431/319 |
| 2,480,772 | 8/1949 | Reimenschneider | 431/153 |
| 3,572,305 | 3/1971 | Moragne | 123/146.5 |
| 3,620,198 | 11/1971 | Breitschwerdt et al. | 123/136 |
| 3,885,547 | 5/1975 | Doepke et al. | 123/198 D |
| 4,150,654 | 4/1979 | Heitzman et al. | 123/179 |
| 4,338,896 | 4/1982 | Papasideris | 123/198 D |
| 4,995,357 | 2/1991 | Gonnering et al. | 123/198 D |
| 5,080,578 | 1/1992 | Josephs et al. | 431/33 |
| 5,163,473 | 11/1992 | Strnad, Jr. | 137/588 |
| 5,190,019 | 3/1993 | Harvey | 123/630 |

FOREIGN PATENT DOCUMENTS

| | | | |
|---|---|---|---|
| 42317 | 12/1937 | Netherlands | 431/202 |
| 1688 | of 1878 | United Kingdom | 431/319 |
| 1475 | of 1886 | United Kingdom | 431/319 |

*Primary Examiner*—Carl D. Price
*Attorney, Agent, or Firm*—Brooks & Kushman P.C.

[57] ABSTRACT

A liquid fuel burning apparatus having a system for interrupting operation of the apparatus during refueling. The apparatus has a spring biased cable mounted at one end within a slot located proximate a refueling opening. A fuel tank cap has a projection which is adapted to contact a portion of the cable disposed within the slot. When the cap is fully seated on the refuelling opening of the fuel tank, the cable is depressed within the slot by the projection. When the cap is removed, the biasing device causes the cable to move to a released position. For example, this movement of the cable in a specifically disclosed heater embodiment is transmitted via the cable to a wick retracting mechanism which responds by lowering the wick into the reservoir and extinguishing any flames.

12 Claims, 2 Drawing Sheets

SAFETY SYSTEM AND FUEL CAP FOR INHIBITING OPERATION OF AN APPARATUS DURING REFUELING

TECHNICAL FIELD

The present invention relates to a safety system which sensing the removal of a fuel cap from a liquid fuel tank in response to fuel cap removal.

BACKGROUND ART

Many consumer products, vehicles and other apparatus, are equipped with a fuel tank for liquid fuel, such as gasoline, kerosene, or other combustible liquids. Such volatile liquid fuels are inherently dangerous and present a severe fire hazard, especially during refueling operations when the fuel cap is removed from the fuel tank. With many devices, it is important to replace the fuel cap on the fuel filler cap receptacle prior to resuming operation of the device.

If a fuel cap is not replaced on a fuel tank, fuel can spill out of the fuel tank refilling opening, and fumes can emanate from the fuel tank opening. Ignition of vapors or liquid fuel flowing from the fuel tank can cause fuel in the fuel tank to also ignite.

A latent danger exists when a fuel tank is closed by a cap which is not the properly matched cap for the fuel tank, but a similarly sized or improperly gasketed cap. If the improper cap is placed on a fuel tank, fuel can leak from the fuel tank when fuel is emitted with air and if exposed to a spark it can result in a fire or explosion. If the wrong cap is placed on a fuel tank, fuel leakage can occur even though an improper fuel cap was assembled to the fuel tank opening.

Certain devices present foreseeable risk of injury, fire or explosion if operated when the fuel cap is removed. One example of such an inherently dangerous device is a liquid fuel burning heater, such as a kerosene heater or kerosene burning light. It would be desirable to provide a mechanism for inhibiting operation of such devices when the fuel cap is removed because it is known that fumes from spilled fuel or otherwise emanating from the fuel tank can be ignited by the open flame of the heater. A further safety feature that would be desired would be to prevent operation of an apparatus if an improper fuel cap/fuel tank combination is attempted. An interlocking mechanism would have to be a mechanical, "explosion-proof" or "non-spark producing" device.

Liquid fuel burning heaters generally include a fuel tank which supplies fuel through a fuel feedline to a reservoir containing a wick. The combustion rate of the wick is controlled by raising and lowering the wick within the reservoir. Once ignited, greater exposure of the wick to the oxygen of the atmosphere results in increased heat, while submerging the wick within the reservoir reduces the heat generated. If the wick is completely submerged in the reservoir, the flame is extinguished due to oxygen deprivation.

Improper use of such liquid fuel burning heaters inherently presents the well recognized, latent and foreseeable hazard of a sudden, unexpected or uncontrolled fire or explosion. For instance, the use of an inappropriate fuel, such as gasoline, in a kerosene heater can cause excessive flames or a sudden and unexpected, delayed flare up in the heater. Additionally, the use of contaminated fuel in the heater can lead to the excessive flames or a sudden and unexpected, delayed flare up or explosion. There is a foreseeable risk that highly combustible fuel could escape from the reservoir or tank if the fuel cap is not replaced or an improper fuel cap is used. The risk of uncontrolled burning and fire is exacerbated if such heaters are refuelled while operating. It is foreseeable that uncontrolled burning could result from these and other conditions creating intense heat and catastrophic damage.

Certain purported safety features have been included in some prior art devices, including those designed to prevent against tip over of the device having a liquid fuel tank and others which sense excessive heat and cause such devices to shut down. These devices are not proactive in that a fire must begin to burn out of control before they will function. For example, none of the prior art theaters include an automatic apparatus which will effectively eliminate the chance of fire due to fuel spillage during tank refilling.

Accordingly, it is an object of the present invention to provide a heater which will sense the removal of the cap for refilling and proactively eliminate the chance of unwanted combustion of fuel spilled during refuelling.

It is a further object of the present invention to provide a proactive cap presence mechanical interlock mechanism which is mounted outside of the vapor environment in a recessed location so that it is not easily defeatable. It is another object of the present invention to provide a mechanism which is moved in response to the removal of a fuel cap and transmits such movement through a mechanical linkage to a remotely located mechanism for inhibiting operation of the device. For example, in conjunction with liquid fuel burning heaters the present invention provides a mechanical linkage mechanism which will cause the wick to become submerged in the fuel reservoir, thereby extinguishing flames during refueling.

It is still another object of the present invention to provide such a mechanism that will prevent combustion in the absence of a matched fuel tank cap.

DISCLOSURE OF THE INVENTION

The present invention achieves the above object by providing a gas tank cap having an arcuate, axially extending rib which is received in a slot defined by the filler neck of a liquid fuel tank. A mechanically engaged plunger, or other moveable element, is disposed within the slot and engaged by a arcuate, axially extending rib on the cap when the proper cap is secured to the liquid fuel tank. The plunger forms part of a mechanical linkage with a remotely located mechanism for inhibiting operation of an apparatus. An apparatus may include liquid fuel heaters, liquid fuel powered lights, vehicles and implements, including internal combustion engines.

The present invention in one embodiment provides a safety system for a liquid fuel burning heater which has a mechanical interlock operative upon removal of a fuel cap to cause retraction of the wick into the fuel reservoir to extinguish the flames.

More specifically, in conjunction with a liquid fuel burning heater, the present invention has a spring-biased cable mounted at one end to a heater fuel tank proximate a fuel refilling hole. The cable is disposed on the tank and is contacted by a properly configured fuel tank cap. When the cap is fully seated on the fuel tank, the plunger is in a retracted position. When the cap is removed, the biasing device causes the plunger to spring outward. This movement of the plunger is transmitted via the cable to a wick retracting mechanism. This mechanism responds by lowering the wick into the reservoir and extinguishing any flames.

BEST MODE FOR CARRYING OUT THE INVENTION

Figure 1:
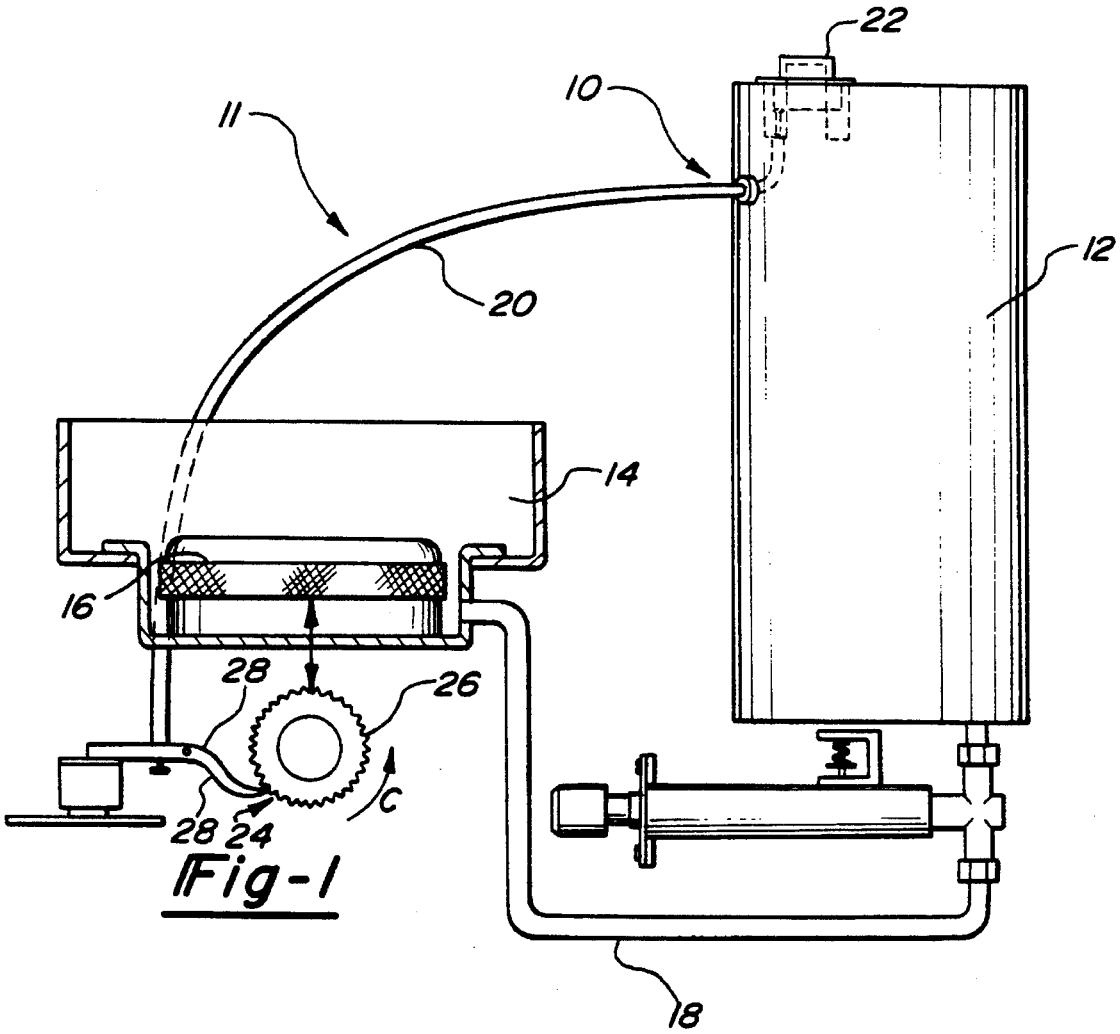
FIG. 1 is an elevational view of a liquid fuel burning heater having the safety system.

Referring to FIG. 1, the safety system of the present invention is generally indicated by the reference numeral 10. There is also shown a heater 11 having a fuel tank 12, a fuel reservoir 14, a wick 16 located within reservoir 14 and a fuel line 18 which connects reservoir 14 and fuel tank 12. There is also shown a spring biased cable 20 mounted proximate to a fuel filler cap 22. Wick retraction means 24 includes a spring biased ratchet gear 26 and a spring biased pawl 28 responsive to movement of cable 20.

Figure 2:
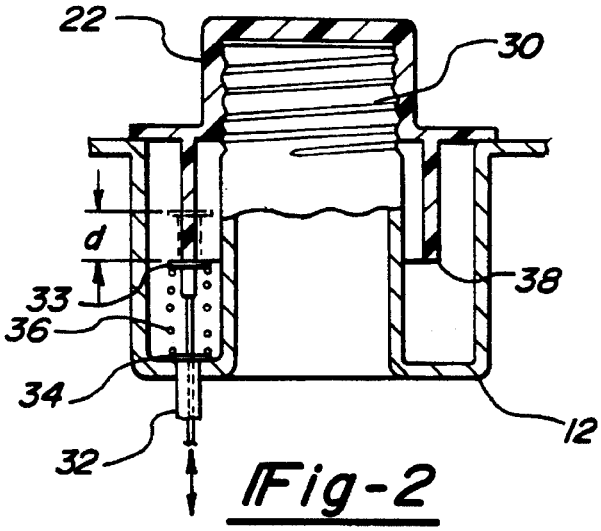
FIG. 2 is a sectional view of the cable mounted on the fuel tank proximate a fuel cap.
Figure 3:
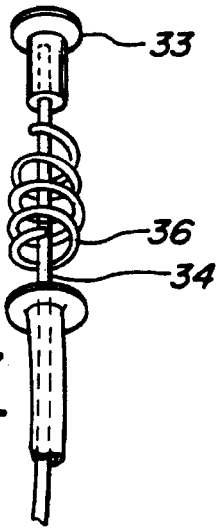
FIG. 3 is a detail of the cable with a spring.

More specifically, as shown in FIGS. 2 and 3, fuel tank 12 has a threaded fuel filler tube 30. First end 34 of cable 20 is mounted in a recess proximate filler tube 30 and is partially contained within a sheath 32. First cable end 34 protrudes into the recess and is biased by spring 36. First end 34 has a flanged cover 33. Fuel filler cap 22 is threaded to correspond with filler tube 30. Cap 22 has an arcuate, axially extending projection 38 that contacts cover 33 when cap 22 is fully seated onto filler tube 30.

When cap 22 is fully seated on filler tube 30, the cable spring 36 is compressed and cable 20 is forced into a retracted position as shown in solid lines in FIG. 2. When cap 22 is removed, cable spring 36 urges first cable end 34 upwards a distance, d, to the position indicated by dashed lines in FIG. 2. This cable motion is transmitted to wick retraction means 24 as described below.

The location of first cable end 34 in a recess protects it from damage and also impedes efforts to circumvent the safety system. First cable end 34 is also located outside the vapor environment to reduce fouling, corrosion, or interference with its operation. Arcuate, axial projection 38 is formed so that it contacts the first cable end 34 when cap 22 is fully seated. Caps lacking the projection 38 will not effectively contact first cable end 34 and the heater 10 will be inhibited from operating.

Figure 4:
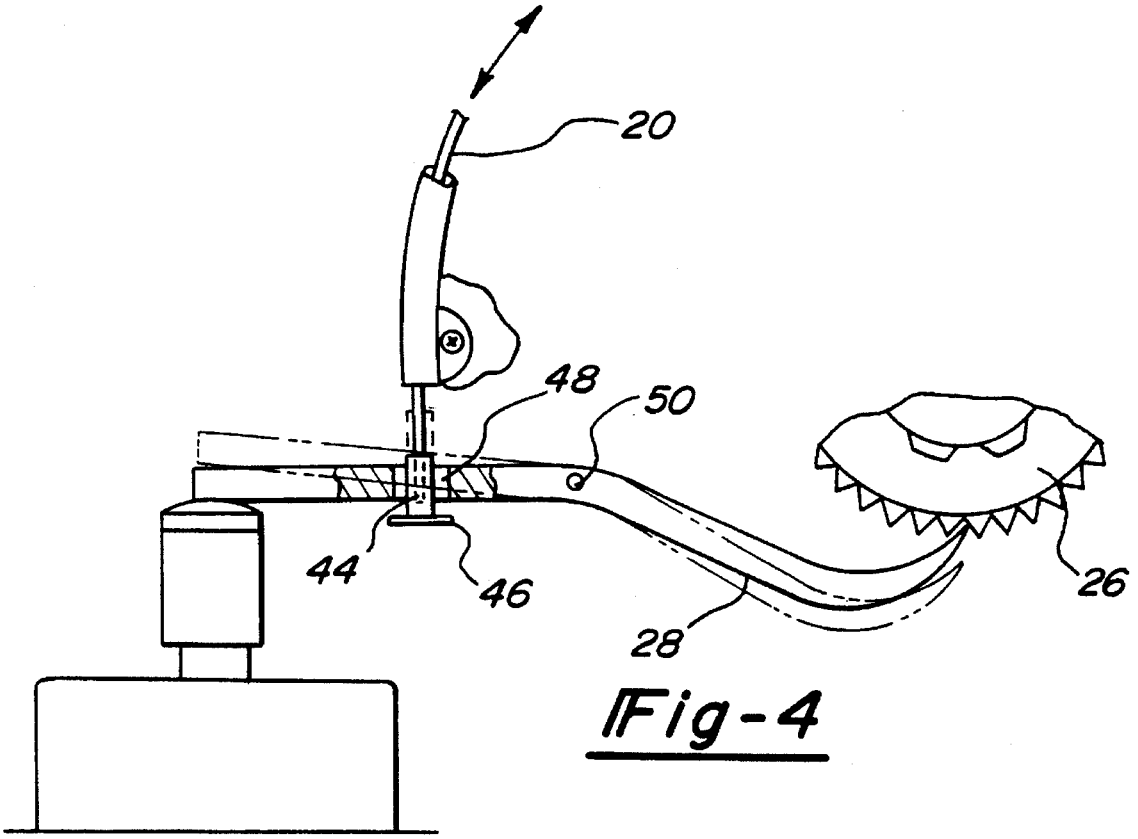
FIG. 4 is an elevational view of the cable operable with a ratchet and pawl mechanism.
Figure 5:
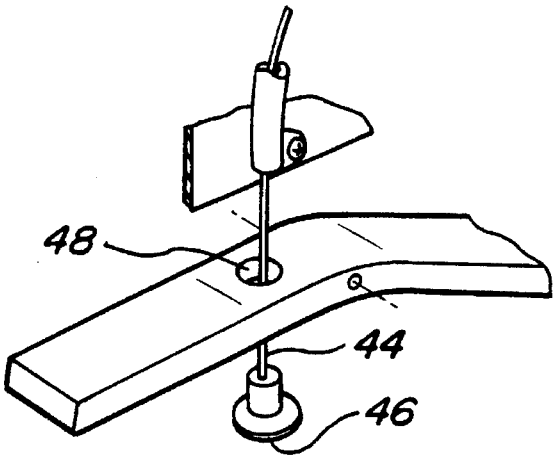
FIG. 5 is a detail of the cable within the pawl.

The structure and operation of retraction means 24 is illustrated in FIGS. 1, 4 and 5. As shown in FIG. 1, wick 16 lies within reservoir 14 and is movable vertically with respect to reservoir 14. Vertical movement of wick 16 is effected by rotation of ratchet gear 26. Rotation of ratchet gear 26 in direction C causes wick 16 to move upwards and out of reservoir 14. Rotation in a direction opposite arrow C causes wick 16 to be lowered into reservoir 14. Ratchet gear 26 is biased by conventional means in a direction opposite that shown by arrow C. This biasing tends to rotate ratchet gear 26 in such a manner as to lower wick 16 into reservoir 14.

As shown in FIG. 4, ratchet gear 26 is locked in position by pawl 28. Pawl 28 is biased by conventional means to remain in contact with ratchet gear 26. As shown in FIG. 5, pawl 28 has an opening 48 through which cable end 44 passes terminating in a flange 46. The diameter of flange 46 is greater than that of opening 48, and therefore flange 48 cannot pass through opening 48.

In operation, removal or loosening of cap 22 causes first cable end 34 to spring outward with respect to fuel tank 12. Second cable end 44 moves with first cable end 34. This movement brings flange 46 to bear on the underside of pawl 28. In turn, this force causes rotation of pawl 28 on fulcrum 50 which releases pawl 28 from contact with ratchet gear 26. Ratchet gear 26 rotates in such a manner as to lower wick 16 within reservoir 14 and extinguish all flames.

When refueling has been completed and cap 22 is replaced onto tube 30, cable 20 translates in such a manner as to free pawl 28 to lock into position against ratchet gear 26. Ratchet gear 26 may then be rotated in direction C to raise wick 16 out of reservoir 14 for lighting.

It will readily be seen that the system described for use in a liquid fuel burning device can be adapted for use in other devices involving combustible fuel including, but not limited to, motor vehicles, lanterns, and lawn and garden equipment. In such apparatus, the wick lowering feature described above could, for example, be replaced by a fuel system cut-off valve or remotely located switch actuator.

While the best mode for carrying out the invention has been described in detail, those skilled in the art to which the invention relates will recognize alternative designs and embodiments for practicing the invention as defined by the following claims.

What is claimed is:

1. A safety system for a liquid fuel combusting apparatus comprising:

a tank having a refueling opening;

a filler cap receptacle encompassing the refueling opening and having defined thereabout a periphery;

a cap adapted to be removed from and seated on the filler cap receptacle;

an elongated mechanical link having a first end contained within a recess defined by the filler cap receptacle;

means for interrupting operation of an preventing hazard from the apparatus;

said elongated mechanical link having a second end mechanically engaging said means for interrupting operation of the apparatus;

said elongated mechanical link being engaged by a lower face of an annular projection formed on said cap which is received in the recess defined by the filler cap receptacle, wherein said recess is an annular slot formed about the periphery of the filler cap receptacle.

2. The safety system of claim 1, wherein said annular projection formed on said cap is an axially extending annular projection.

3. The safety system of claim 2, wherein the location of the first end of the mechanical link within the annular slot prevents intentional contravening of safety system by blocking movement of the mechanical link.

4. A safety system for a liquid fuel combusting apparatus comprising:

a tank having a opening:

a filler cap receptacle encompassing the refueling opening;

a cap adapted to be removed from and seated on the filler cap receptacle;

an elongated mechanical link having a first end contained within a recess defined by the filler cap receptacle;

means for interrupting operation of an preventing hazard from the apparatus;

said elongated mechanical link having a second end mechanically engaging said means for interrupting operation of the apparatus;

said elongated mechanical link being engaged by an annular projection formed on said cap which is received in the recess defined by the filler cap receptacle, wherein said elongated mechanical link is a cable.

5. The safety system of claim 4, wherein said cable is engaged by a spring which urges the cable toward a first position, and wherein seating said cap on the filler cap receptacle causes the cable to shift to a second position in which said liquid fuel combusting apparatus is enabled to operate only when the cable is in its second position and not enabled when said cable is in its first position.

6. The safety system of claim 5, wherein the location of the first end of the mechanical link within the recess prevents intentional contravening of the safety system by blocking movement of the cable.

7. The safety system of claim 6, wherein the cable is spring biased toward the first position.

8. A liquid fuel burning heater apparatus in which the flames are extinguished before and during refueling, comprising:

a fuel tank;

a fuel filler tube mounted on the tank;

an elongated member mounted at one end on the fuel filler tube, said elongated member being movable between a released position and a depressed position;

a spring biasing said elongated member toward the released position;

a fuel filler cap having a projection for contacting elongated member and holding said elongated member in the depressed position when said cap is seated on filler tube;

a reservoir;

a wick located within the reservoir and movable between extended and retracted positions with respect to the reservoir;

said elongated member operatively engaging the wick to move the wick between the extended and retracted positions as the elongated member is moved between the depressed and released positions respectively, wherein movement of the wick to the retracted position in the reservoir thereby extinguishes any flame on the wick; and said wick being moved to the retracted position when the fuel filler cap is removed from the fuel filler tube and to the extended position when the fuel filler cap is seated on the fuel filler tube.

9. The apparatus as recited in claim 8 wherein the elongated member is recessed within a slot formed on the fuel filler tube and said fuel filler cap includes projection which contacts the elongated member moving it to the depressed position only when the cap is seated thereby inhibiting operation of the heater or other apparatus.

10. The apparatus as recited in claim 8 wherein the projection is an arcuate, axially projecting portion of the fuel cap.

11. The apparatus as recited in claim 10 wherein the projection is annular in shape.

12. The apparatus as recited in claim 11 wherein the elongated member comprises a cable which engages a pawl to transmit movement of the cable to the pawl for releasing the ratchet.

* * * * *

UNITED STATES PATENT AND TRADEMARK OFFICE

CERTIFICATE OF CORRECTION

PATENT NO. : 5,551,866
DATED : September 3, 1996
INVENTOR(S) : HAROLD JOSEPHS, et al.

It is certified that error appears in the above-indentified patent and that said Letters Patent is hereby corrected as shown below:

| | |
|---|---|
| Column 2, Line 25, | Before "It" begin a new paragraph. |
| Claim 3, Column 4, Line 56, | Before "safety" insert --the--. |
| Claim 4, Column 4, Line 61, | Before "opening" insert --refueling--. |

Signed and Sealed this

Fifteenth Day of April, 1997

Bruce Lehman

*Attest:*

BRUCE LEHMAN

*Attesting Officer*

*Commissioner of Patents and Trademarks*